US006301724B1

(12) United States Patent
Wright

(10) Patent No.: US 6,301,724 B1
(45) Date of Patent: Oct. 16, 2001

(54) CORNER AND BATHTUB ACCESSORY DEVICE

(76) Inventor: Dawell L. Wright, 4320 SE. 13th St., Del City, OK (US) 73115

( * ) Notice: Subject to any disclaimer, the term of this patent is extended or adjusted under 35 U.S.C. 154(b) by 0 days.

(21) Appl. No.: 09/639,505

(22) Filed: Aug. 17, 2000

Related U.S. Application Data

(60) Provisional application No. 60/154,648, filed on Sep. 20, 1999.

(51) Int. Cl.[7] ..... A47K 3/00
(52) U.S. Cl. ..... 4/559; 211/119.011
(58) Field of Search ..... 4/553, 554, 559, 4/548, 579; 211/119.011

(56) References Cited

U.S. PATENT DOCUMENTS 2,006,169 * 6/1935 Harris-Jones ..... 4/559
2,322,147 * 6/1943 Landauer ..... 4/579 X
3,239,850 * 3/1966 Kiss ..... 4/559
4,574,407 * 3/1986 Didia ..... 4/559

FOREIGN PATENT DOCUMENTS

8480 * 7/1928 (AU) ..... 4/553
676050 * 2/1930 (FR) ..... 4/553
17457 * of 1888 (GB) ..... 4/559
257771 * 9/1926 (GB) ..... 4/553

* cited by examiner

*Primary Examiner*—Robert M. Fetsuga
(74) *Attorney, Agent, or Firm*—Randal D. Homburg

(57) ABSTRACT

The invention relates to a device to be placed across the sides of a bathtub for placement of accessories, bathing articles and products and bathtub toys, providing a draining basket to allow toys or other articles to drain after use and multiple compartments in the single-piece molded waterproof device, which is detachable from the tub, yet secured in a fashion to prevent accidental displacement of the device from the bathtub.

1 Claim, 2 Drawing Sheets

CORNER AND BATHTUB ACCESSORY DEVICE

CROSS REFERENCE TO RELATED APPLICATIONS

Provisional Patent Application No. 60/154,648 filed on Sep. 20, 1999.

I. BACKGROUND OF INVENTION

1. Field of the Invention

The invention relates to a device to be placed across the sides of a bathtub for placement of accessories, bathing articles and products and bathtub toys, providing a draining basket to allow toys or other articles to drain after use and multiple compartments in the single-piece molded waterproof device, which is detachable from the tub, yet secured in a fashion to prevent accidental displacement of the device from the bathtub.

2. Description of Prior Art

Bathroom and bathtub accessories, in a variety of form and function, are well represented in the market. Many of them contain similar features and function as the current invention, but none of them have the identical features and functions of the current invention, nor do they provide the space conscious design and secure attachment of the disclosed invention.

The following United States patents are disclosed and incorporated within this provisional patent application. A sidewall attaching bathtub tray, having telescoping side adjustment, intended for containing bathing accessories including soap and shampoos, is disclosed in U.S. Pat. No. 5,940,903 to Yemini. In U.S. Pat. No. 5,702,003, to Springer, a toy containing storage chamber, having a draining collection chamber below a perforated draining platform is disclosed, and is illustrated with a decorative top portion in which the toys may be stored, or is alternatively illustrated with the toys encased in the body of the toy storage device. A similar drainage device is disclosed in U.S. Pat. No. 5,350,058 to Keough, in that a draining platform is located above a moisture collection chamber in this free-standing bath toy device.

U.S. Pat. No. 4,727,606 to Cavey discloses a wall mounted bathroom storage accessory having a waterproof sheet with a decorative embossment containing several storage hooks and trays. In U.S. Pat. No. 5,175,896 to Zamir, a wall mounted massage unit is disclosed having a suction cup-type attachment. A soap container having a drainage platform is disclosed in U.S. Pat. No. 5,279,412 to Lee, providing a bristled drainage surface for soap, allowing the moisture on the bar of soap to drain above a separated chamber below, away from the under-surface of the soap. A coated wire bathtub basket and accessory is disclosed in U.S. Pat. No. 4,053,954 to Chapman, which is placed above and between the opposing sides of the tub, preferably under the spigot of the bathtub, such device containing dual baskets with depressions for soap, shampoo and other bathing items, and has a washcloth rack connecting the two baskets.

Several design patents are also disclosed which include bathtub and bathroom shelves with drain features and segregated compartments, including the ability to span the width of the bathtub resting on the sides of the bathtub, but do not include the features of the current invention.

II. SUMMARY OF THE INVENTION

A principle objective of the invention is to provide a bathtub accessory that is placed in the least obstructive location of the bathtub, the area farthest from the spigot, which is contoured to the shape of the tub fixture, suited for containing bathing toiletries.

Another objective is to provide a device which would contain a liberal amount of children's bathtub toys and allow ample drainage.

A further objective is to provide the device with a secure, yet removable attachment to the tub to reduce the dislocation of the device by accidental or unintentional contact. To accomplish these objectives, the device is embodied in the accompanying drawings and preferred embodiment, realizing, however, that the drawings are merely illustrative only, and that changes may be made to the specific construction contained within the scope of the detailed description below.

III. DESCRIPTION OF THE DRAWINGS

The following formal drawings submitted with this utility patent application are incorporated herein a illustrations of the embodiments of the invention.

IV. DESCRIPTION OF THE PREFERRED EMBODIMENT

Figure 3:
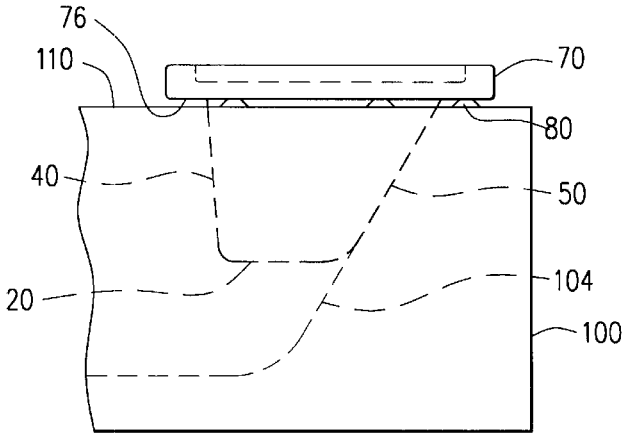
FIG. 3 is a second side view of the invention placed in a bathtub.
Figure 4:
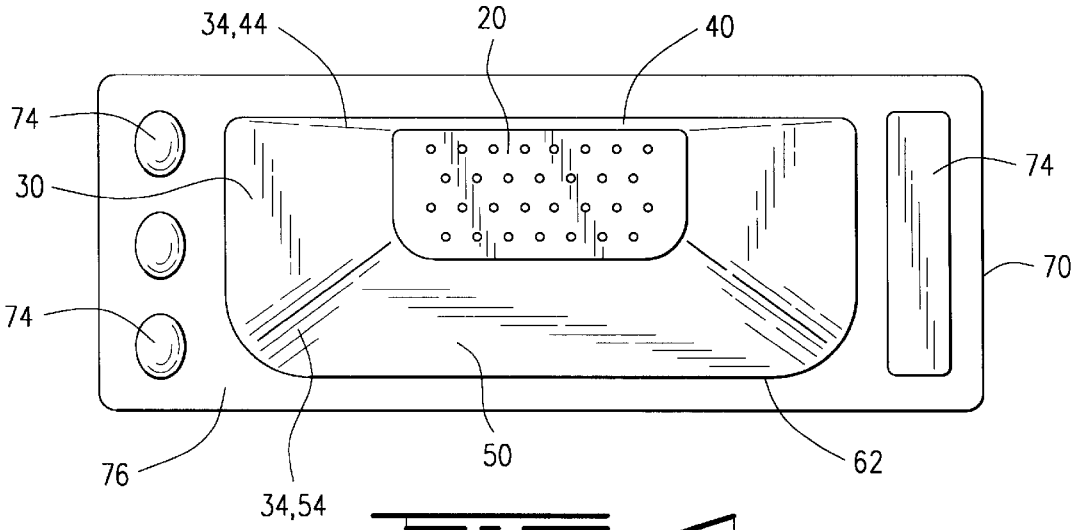
FIG. 4 is a view of a placement of an embodiment of a removable attachment means in relation to the invention.
Figure 5:
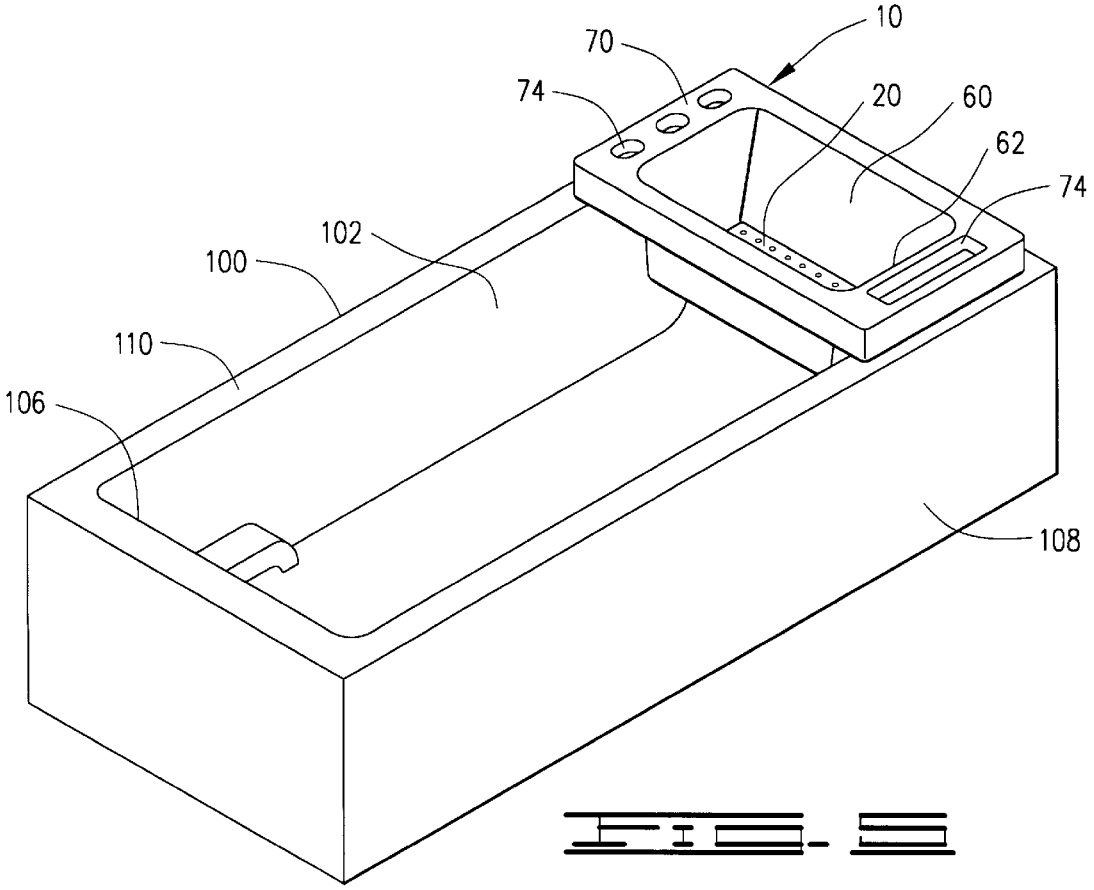
FIG. 5 is a perspective view of the invention in a bathtub.

The invention, as shown in FIGS. 1–5 of the drawings, is a corner and bathtub accessory device 10 for use in a bathtub 100, providing an additional storage and draining area for bathing accessories, bathing articles and products and children's bath toys, the invention 10 comprising, preferably, a single-piece molded water-resisting material having a basket area 60 formed by a perforated bottom 20, at least two side panels 30, a front panel 40, a rear panel 50, and a horizontal support tray 70. The bathtub 100 to which the device is applied is a standard bathtub, having relatively parallel sides 102, a rear wall 104, a spigot end 106, an opposite end 108 opposing the spigot end 106 and an upper edge 110 surrounding the entire bathtub 100, as shown in FIG. 5 of the drawings. The side panels 30 each have an upper section 32, side sections 34 and a lower section 36, the lower section 36 connected to the perforated bottom 20. The front panel 40 has an upper section 42, side sections 44 and a lower section 46, the lower section 46 connected to the perforated bottom 20 and the side sections 44 of the front panel 40 are connected to the side sections 34 of the side panels 30. The rear panel 50 also has an upper section 52, side sections 54 and a lower section 56, such lower section 56 attached to the perforated bottom 20. Such rear panel 50, most preferably, should conform in shape to the slope and contour of the rear wall 104 of the bathtub 100. The side sections 54 of the rear panel 50 are connected to the side sections 34 of the side panels 30.

Figure 1:
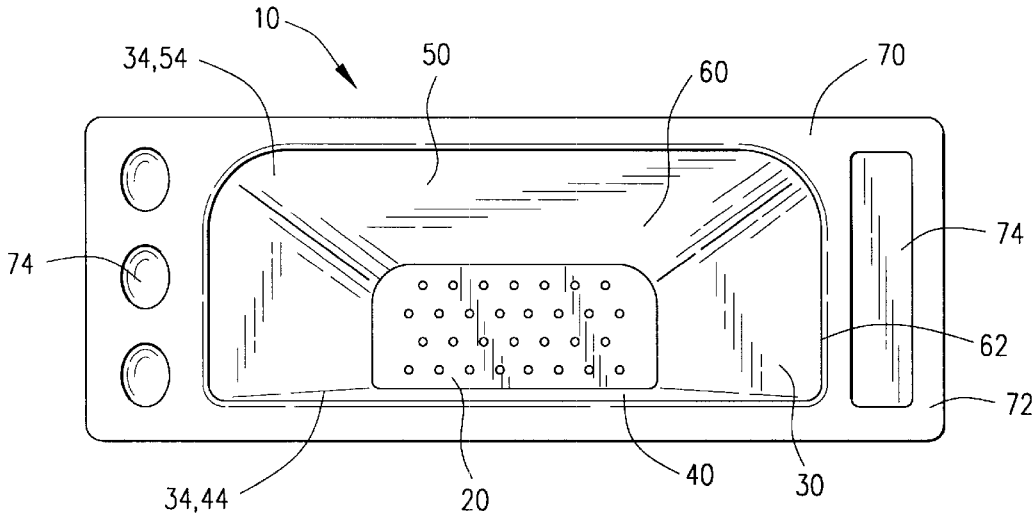
FIG. 1 is a top view of the apparatus.
Figure 2:
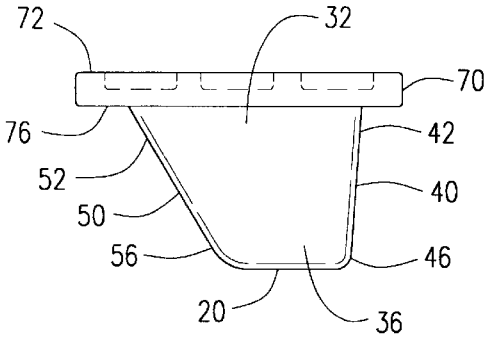
FIG. 2 is a side view of the apparatus.

The upper section 32 of the side panels 30, the upper section 42 of the front panel 40 and the upper section 52 of the rear panel 50 define a basket rim 62, as shown in FIGS. 1, 4 and 5 of the drawings. Parallel to the perforated bottom 20, emanating from the basket rim 62, as shown in FIGS. 2 and 3 of the drawings, is the horizontal support tray 70, which has an upper surface 72 and a lower surface 76. The upper surface 72 is supplied with a plurality of indented impressions 74 for accommodating shampoo bottles, soap, hygiene product containers and other bath cleansing products.

The lower surface 76 of the horizontal support tray 70 rests upon the upper edge 110 of the bathtub 100 and attaches to the bathtub by a removable attachment means 80 affixed to the lower surface 76 of the horizontal support tray 70, as shown in FIG. 3 of the drawings. Most preferably, the invention 10 is placed in the opposite end 108 opposing the spigot end 106 of the bathtub 100 against the rear wall 104 of the bathtub 100, such opposite end 108 opposing the spigot end 106 of the bathtub 100 presenting the least disruptive location to place the invention 10 within the bathtub 100, as shown in FIG. 5 of the drawings. Such removable attachment means 80 is preferably provided as suction cups, adhesive buttons and hooks, and hook-and-loop type attachments. The removable attachment means 80 should be secure enough to prevent accidental displacement of the invention 10 from the upper edge 110 of the bathtub 100, but not so secure as to present difficult removal by the user when the device is not needed or desired.

In an alternative embodiment, the side panels 30, front panel 40, rear panel 50 and the indented impressions 74 in the horizontal support tray 70 may also be perforated for enhanced drainage and additional air flow to any contained wet items.

What is claimed is:

1. A corner and bathtub accessory device for use in a bathtub, providing an additional storage and draining area for bathing accessories accessories, bathing articles and products and children's bath toys, the invention comprising:

a. a basket area defined by a perforated bottom, at least two side panels, a front panel, a rear panel;

b. each side panel having an upper section, side sections and a lower section, the lower section connected to the perforated bottom;

c. the front panel having an upper section, side sections and a lower section, the lower section connected to the perforated bottom and the side sections of the front panel are connected to the side sections of the side panels;

d. the rear panel also having an upper section, side sections and a lower section, such lower section attached to the perforated bottom and the side sections of the rear panel are connected to the side sections of the side panels, wherein such rear panel conforms in shape to the slope and contour of a rear wall of the bathtub;

e. the upper section of the side panels, the upper section of the front panel and the upper section of the rear panel defining a basket rim;

f. a horizontal support tray parallel to the perforated bottom, extending from the basket rim, having an upper surface and a lower surface, the upper surface supplied with a plurality of indented impressions for accommodating shampoo bottles, soap, hygiene product product containers and other bath cleansing products, the lower surface of the horizontal support tray resting upon upper edges of the bathtub and attaching to such upper edges of the bathtub by a removable attachment means affixed to the lower surface of the horizontal support tray.

* * * * *